United States Patent [19]

Aoyama

[11] Patent Number: 4,948,143

[45] Date of Patent: Aug. 14, 1990

[54] GOLF BALL

[75] Inventor: Steven Aoyama, Marion, Mass.

[73] Assignee: Acushnet Company, New Bedford, Mass.

[21] Appl. No.: 376,395

[22] Filed: Jul. 6, 1989

[51] Int. Cl.[5] ..... A63B 37/14

[52] U.S. Cl. ..... 273/232; 273/213

[58] Field of Search ..... 273/232, 213, 62, 235 R; 40/327

[56] References Cited

U.S. PATENT DOCUMENTS

| | | | |
|---|---|---|---|
| 4,560,168 | 12/1985 | Aoyama | 273/232 |
| 4,729,861 | 3/1988 | Lynch et al. | 273/232 X |
| 4,762,326 | 8/1988 | Gobush | 273/232 |
| 4,765,626 | 8/1988 | Gobush | 273/232 |
| 4,772,026 | 9/1988 | Gobush | 273/232 |

FOREIGN PATENT DOCUMENTS

| | | | |
|---|---|---|---|
| 377354 | 7/1932 | United Kingdom | 273/232 |

*Primary Examiner*—George J. Marlo

*Attorney, Agent, or Firm*—Lucas & Just

[57] ABSTRACT

A golf ball having dimples covering its surface and having four great circular paths on the surface of the golf ball where none of the paths intersect a dimple is disclosed. The four great circular paths are obtained by laying out an octahedron on the surface of the golf ball and connecting the midpoint of each edge of the octahedron to form eight equilateral triangles and four squares. The dimples are arranged by filling each triangle and square with dimples. Golf balls having four great circular paths and 456, 408 and 432 dimples are disclosed.

13 Claims, 8 Drawing Sheets

GOLF BALL

The present invention relates to golf balls and, more particularly, to golf balls having four parting lines with dimples evenly and uniformly distributed over the surface of the ball such that no dimples intersect any parting line.

Typically, golf balls are made in a molding process that imparts a single mold parting line on the ball. Attempts have been made to increase the number of parting lines on a golf ball by adding so-called false parting lines. Often, such attempts have produced large, bald spots or parting lines that intersect dimples. Both of these outcomes are undesirable. Some recent attempts are disclosed in U.S. Pat. Nos. 4,560,168; 4,762,326; 4,765,626; and 4,772,026. In the '168 patent, the dimples are arranged on the surface of a golf ball by first dividing the spherical surface of the golf ball into twenty triangles corresponding to a regular icosahedron, and then subdividing each triangle so formed into four smaller triangles. Those smaller triangles are formed by joining the midpoints of each of the sides of the icosahedron triangles. The six parting lines are coextensive with the lines that join the midpoints. This pattern produces 20 triangular groups of dimples and 12 pentagonal groups of dimples.

The '326 patent teaches a golf ball with seven parting lines or seven great circular paths. The seven great circular paths are obtained by laying out 32 triangles on the surface of the golf ball and then arranging dimples inside the triangles. The seven great circular paths correspond to the edges of the triangles.

The '626 patent teaches a golf ball with three parting lines or great circular paths. The three great circular paths are located by dividing the square faces of a truncated octahedron in four triangles and then laying out dimple patterns inside the 24 triangles and eight hexagons.

The '026 patent teaches a golf ball having six parting lines or six great circular paths. The six parting lines are created by placing 24 triangles on the surface of a golf ball and then filling the triangles with dimples.

The United States Golf Association (USGA) promulgates rules, one of which is directed to symmetry of a golf ball. The USGA symmetry requirement dictates that a golf ball must perform generally as if it were spherically symmetrical. Meeting this requirement is difficult when the total number of geometric figures used to arrange dimples is large. It is also difficult to arrange a high number of dimples over the surface of a golf ball when the geometric figures used to arrange dimples have a small area and are large in number.

The present invention provides a golf ball having four parting lines which correspond to four great circular paths that encircle the golf ball where none of the parting lines intersects any of the dimples. The dimples are arranged in two patterns. One pattern is square while the other pattern forms a triangle. The surface of the golf ball is covered with six squares and eight triangles, both of which occupy fairly large areas on the surface of the golf ball. It has been found that such a pattern lends itself to good overall surface coverage and minimum fret area and is especially suited for arrangement of multiple sized dimples on the surface of the golf ball.

A golf ball is made in accordance with the present invention by dividing the surface of the golf ball into six squares and eight equilateral triangles. These triangles and squares are located by inscribing an octahedron inside the spherical surface of a golf ball, locating the midpoint on each edge of the octahedron and then connecting each of the midpoints. The geometric form left after connecting the midpoints has six squares and eight equilateral triangles. The great circular paths follow the edges of the squares and triangles so formed. Each one of the four great circular paths passes through six midpoints. The four great circular paths correspond to the position of the parting lines on the surface of the golf ball. The parting lines are coextensive with the four great circular paths. Preferably, the mold parting line corresponds to one of the parting lines of the present invention, while the other three parting lines are false parting lines.

Dimples are evenly and uniformly distributed over the surface of the golf ball by arranging dimples inside each of the six squares and in each of the eight equilateral triangles, making sure that none of the dimples intersects any of the common edges. The dimples may be of any size, shape and number to include patterns with multiple sized dimples. Preferably, at least about 50% of the surface of the golf ball is covered with dimples and, more preferably, at least about 65% of the surface of the golf ball is covered with dimples. Preferably, each square has the same dimple pattern as every other square on the surface of the golf ball and each triangle has the same dimple pattern as every other triangle on the surface of the golf ball.

The preferred dimple patterns have 456, 408, and 432 dimples. Some manufacturers remove a small number of dimples, typically eight, four at each pole, so that a trademark and identification number can be affixed to the ball. However, modern stamping methods allow for affixing trademarks and identification numbers without the removal of dimples.

These and other aspects of the present invention may be more fully described with reference to the accompanying drawings wherein.

Figure 1:
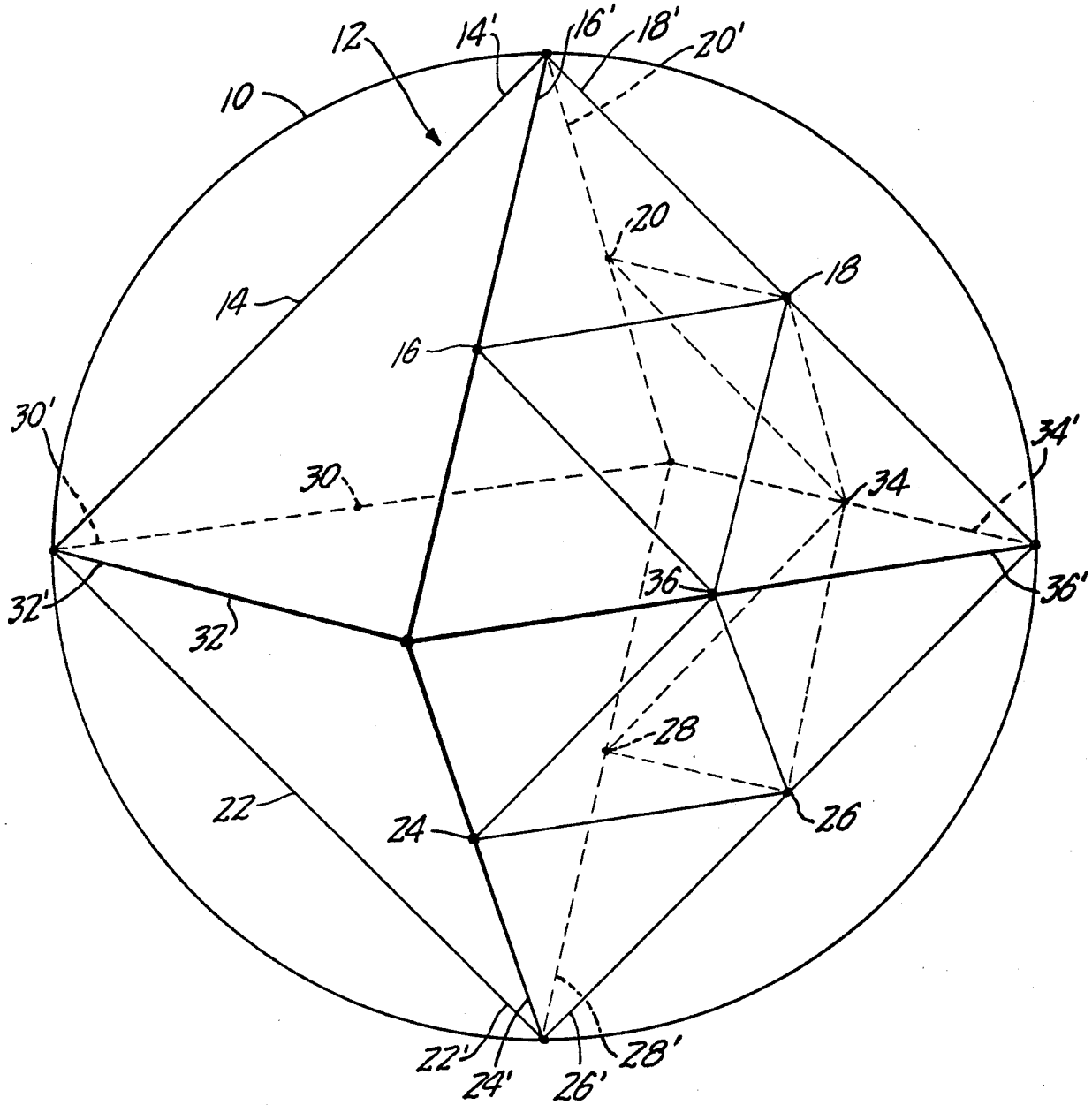
FIG. 1 illustrates an octahedron inscribed in a sphere in accordance with the present invention.

FIG. 1 illustrates sphere 10 inside of which octahedron 12 is inscribed. The twelve midpoints of each edge of octahedron 12 are numbered 14, 16, 18, 20, 22, 24, 26, 28, 30, 32, 34 and 36. The edges are identified in FIG. 1 by a prime, i.e. 14', 16', 18', 20', 22', 24', 26', 28', 30', 32', 34' and 36'. By connecting each set of midpoints of each side of each face of octahedron 12, an equilateral triangle is created, thus making the eight equilateral triangles of the present invention. For example, midpoints 16, 18 and 36 are connected to create an equilateral triangle having its three vertices identified by the set of three midpoints 16-18-36. The same has been done for all four faces of the octahedron on the right side of FIG. 1. Specifically, the three remaining equilateral triangles on the right-hand side of FIG. 1 are identified by sets of three midpoints: 24-26-36; 26-28-34; and 18-20-34. These sets of midpoints identify the vertices of each equilateral triangle. It is clear that by connecting the midpoints of edges 14', 16', 20', 22', 24', 28', 30' and 32' on the left-hand side of FIG. 1 that the remaining four equilateral triangles are formed. These remaining four equilateral triangles are identified by the following sets of three midpoints: 14-16-32; 14-20-30; 22-24-32; and 22-28-30.

The four corners of the six squares are also identified as four midpoints which correspond to the four corners of the square. Specifically, these squares are formed about each one of the six apexes of the octahedron. The four corners of each of the six squares correspond to the following six sets of four midpoints: 18-36-26-34; 16-18-20-14; 14-32-22-30; 34-20-30-28; 28-22-24-26; and 36-16-32-24.

It should be noted that in connecting the midpoints of each edge of the octahedron only the midpoints belonging to one face are interconnected and none of the midpoints on one face are connected to midpoints on another face, except where there is a common edge. In other words, all midpoint connecting lines travel on the surface of the octahedron, not through the octahedron.

Each one of the four great circular paths passes through six midpoints of the edges of the octahedron and corresponds to the edges of the equilateral triangles and squares which were formed in the manner described above. Each great circular path is defined by the following set of six midpoints: 24-36-18-20-30-22; 24-26-34-20-14-32; 16-18-34-28-22-32; and 16-14-30-28-26-36.

Figure 2:
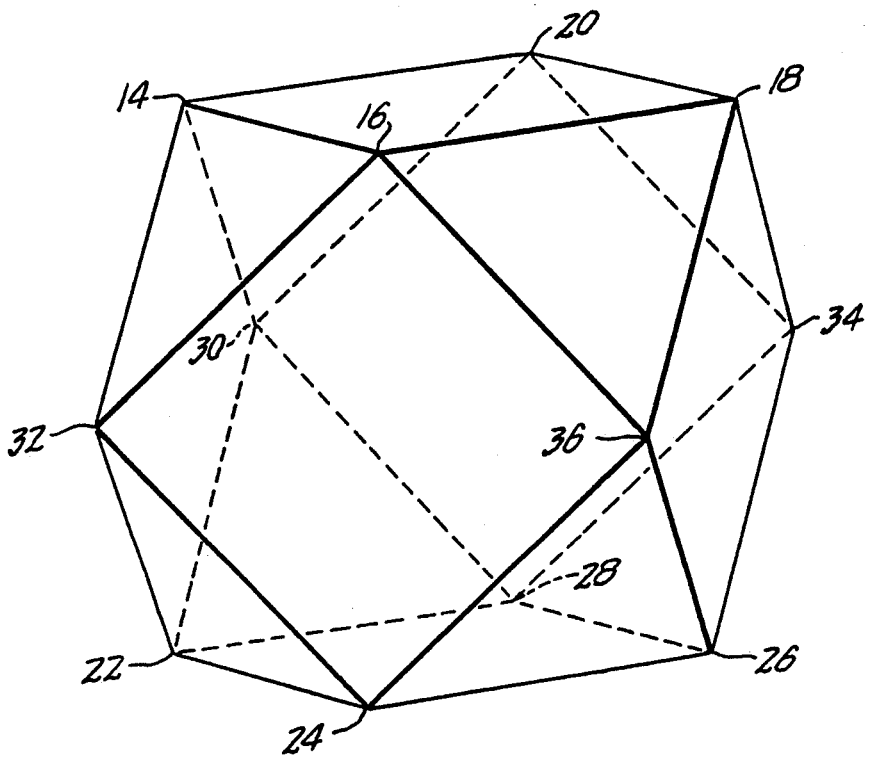
FIG. 2 illustrates the figure formed by the equilateral triangles and squares in accordance with the present invention.

These paths are clear from FIG. 2 wherein the lines representing the octahedron have been deleted and the lines connecting the midpoints remain. The midpoints are identified in FIG. 2. The four parting lines correspond to the four great circular paths.

The four great circular paths have a diameter equal to sphere 10. Dimples are arranged within the geometric figures, equilateral triangles and squares, formed between the great circular paths. None of the great circular paths intersects the dimples.

Figure 3:
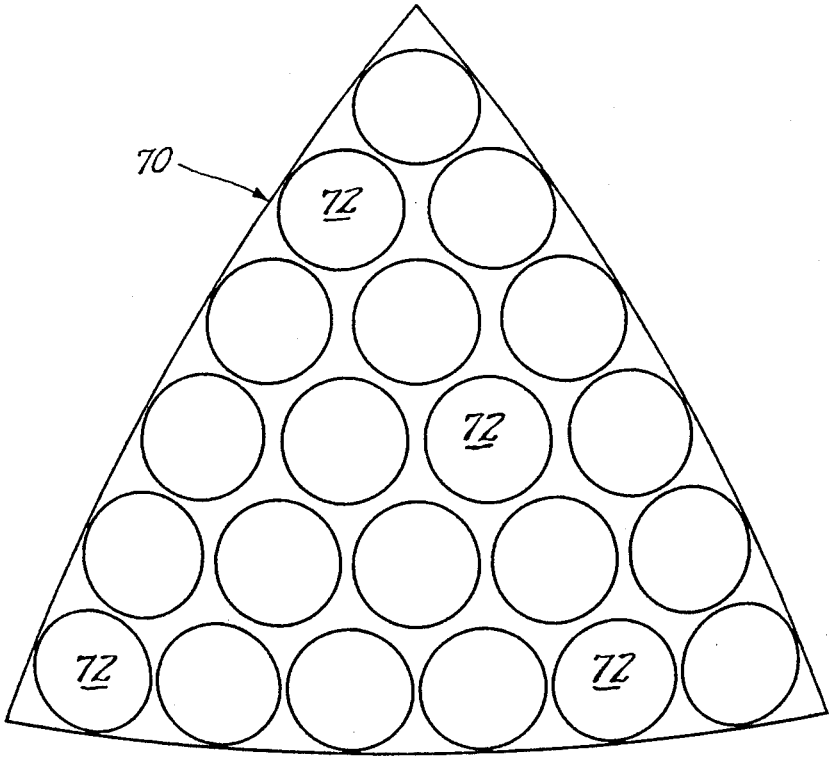
FIG. 3 illustrates a preferred equilateral triangle having a dimple pattern for a golf ball with 456 dimples made in accordance with the present invention.
Figure 4:
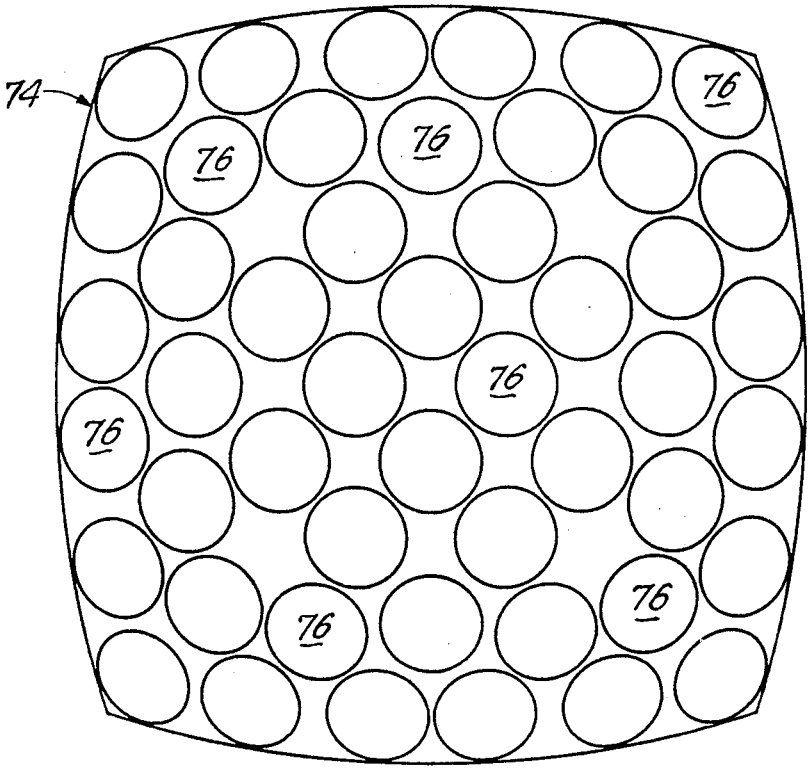
FIG. 4 illustrates a preferred square having a dimple pattern for a golf ball with 456 dimples made in accordance with the present invention.

FIGS. 3 and 4 illustrate a preferred dimple pattern of an equilateral triangle and a square used for making a golf ball in accordance with the present invention having 456 dimples thereon. FIG. 3 illustrates a preferred equilateral triangle 70 having a dimple pattern in accordance with the present invention for making a golf ball with 456 dimples. Dimples 72 have a maximum dimple diameter of about 0.136 inches. FIG. 4 illustrates a preferred square 74 having a dimple pattern for a golf ball made in accordance with the present invention. Such a pattern produces a preferred 456 dimples when used with the triangle of FIG. 3. Dimples 76 have a maximum dimple diameter of about 0.139 inches.

Figure 5:
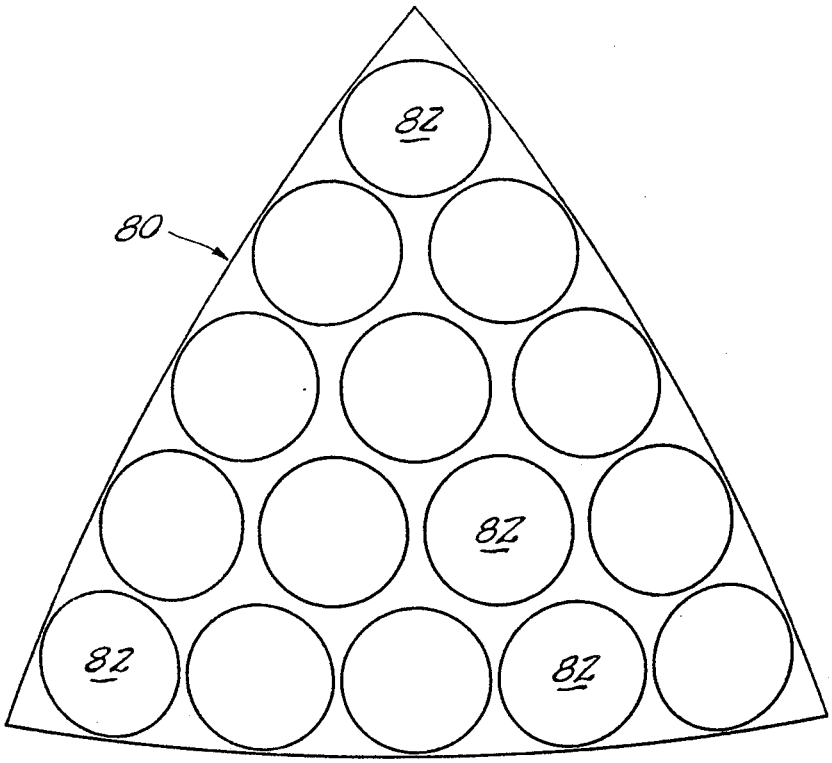
FIG. 5 illustrates a preferred equilateral triangle having a dimple pattern for a golf ball with 408 dimples made in accordance with the present invention.
Figure 6:
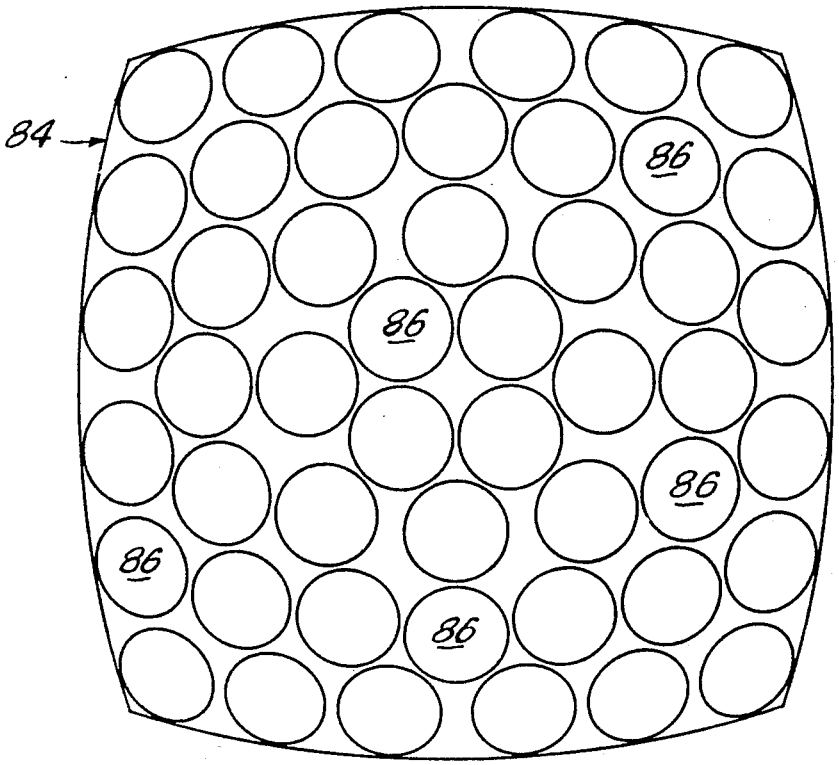
FIG. 6 illustrates a preferred square having a dimple pattern for a golf ball with 408 dimples made in accordance with the present invention.

FIGS. 5 and 6 illustrate a preferred dimple pattern of an equilateral triangle and a square used to make a golf ball in accordance with the present invention having 408 dimples. FIG. 5 illustrates a preferred equilateral triangle 80 having a dimple pattern for a golf ball made in accordance with the present invention such that a golf ball with a preferred 408 dimples is produced. Dimples 82 have a maximum dimple diameter of about 0.161 inches. FIG. 6 illustrates a preferred square 84 having a dimple pattern for a golf ball made in accordance with the present invention such that a golf ball with a preferred 408 dimples is produced. Dimples 86 have a maximum dimple diameter of about 0.141 inches.

Figure 7:
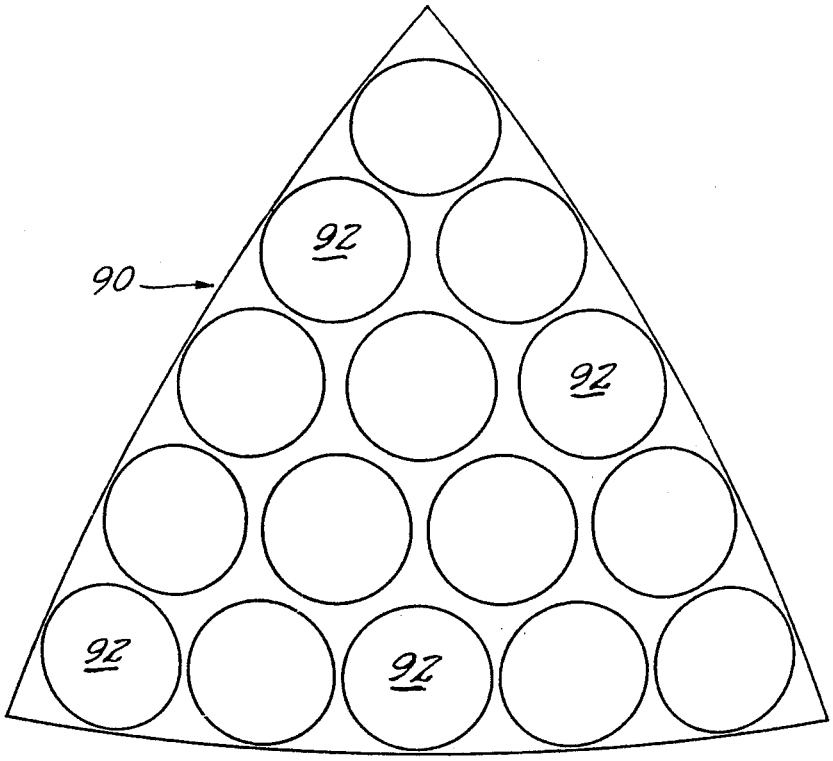
FIG. 7 illustrates a preferred equilateral triangle of a dimple pattern for a golf ball with 432 dimples made in accordance with the present invention.
Figure 8:
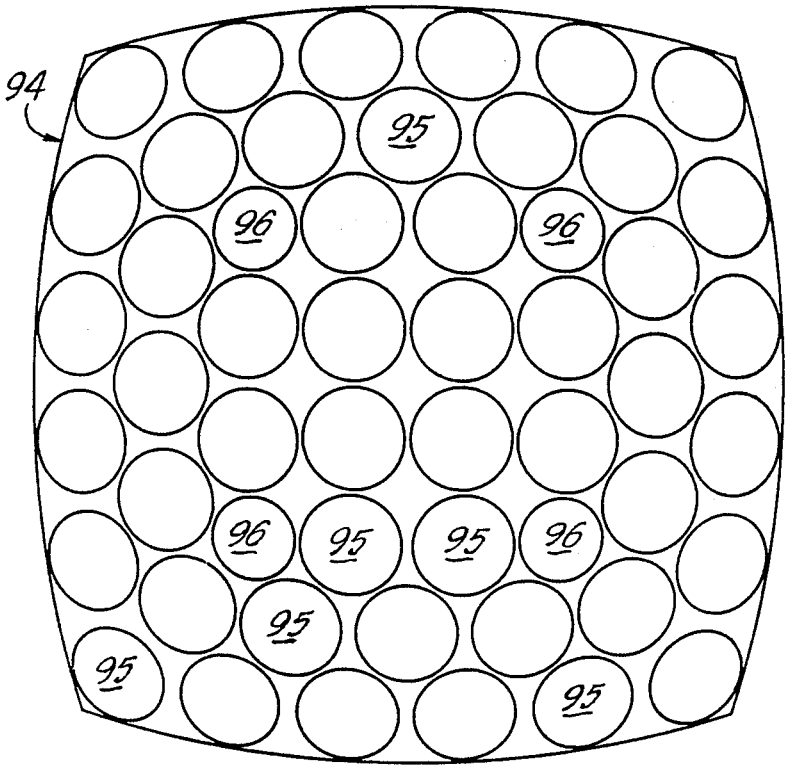
FIG. 8 illustrates a preferred square having a dimple pattern for a golf ball with 432 dimples made in accordance with the present invention.

FIGS. 7 and 8 illustrate a preferred dimple pattern for an equilateral triangle and a square used to make a golf ball in accordance with the present invention and having 432 dimples thereon. FIG. 7 illustrates a preferred equilateral triangle 90 having a dimple pattern for a golf ball made in accordance with the present invention such that a golf ball with a preferred 432 dimples is produced. Dimples 92 have a maximum dimple diameter of about 0.161 inches. FIG. 8 illustrates a preferred square 94 having a dimple pattern for a golf ball made in accordance with the present invention such that a golf ball with a preferred 432 dimples is produced. Dimples 95 have a maximum diameter of about 0.139 inches, while dimples 96 have a maximum diameter of about 0.116 inches.

Figure 9:
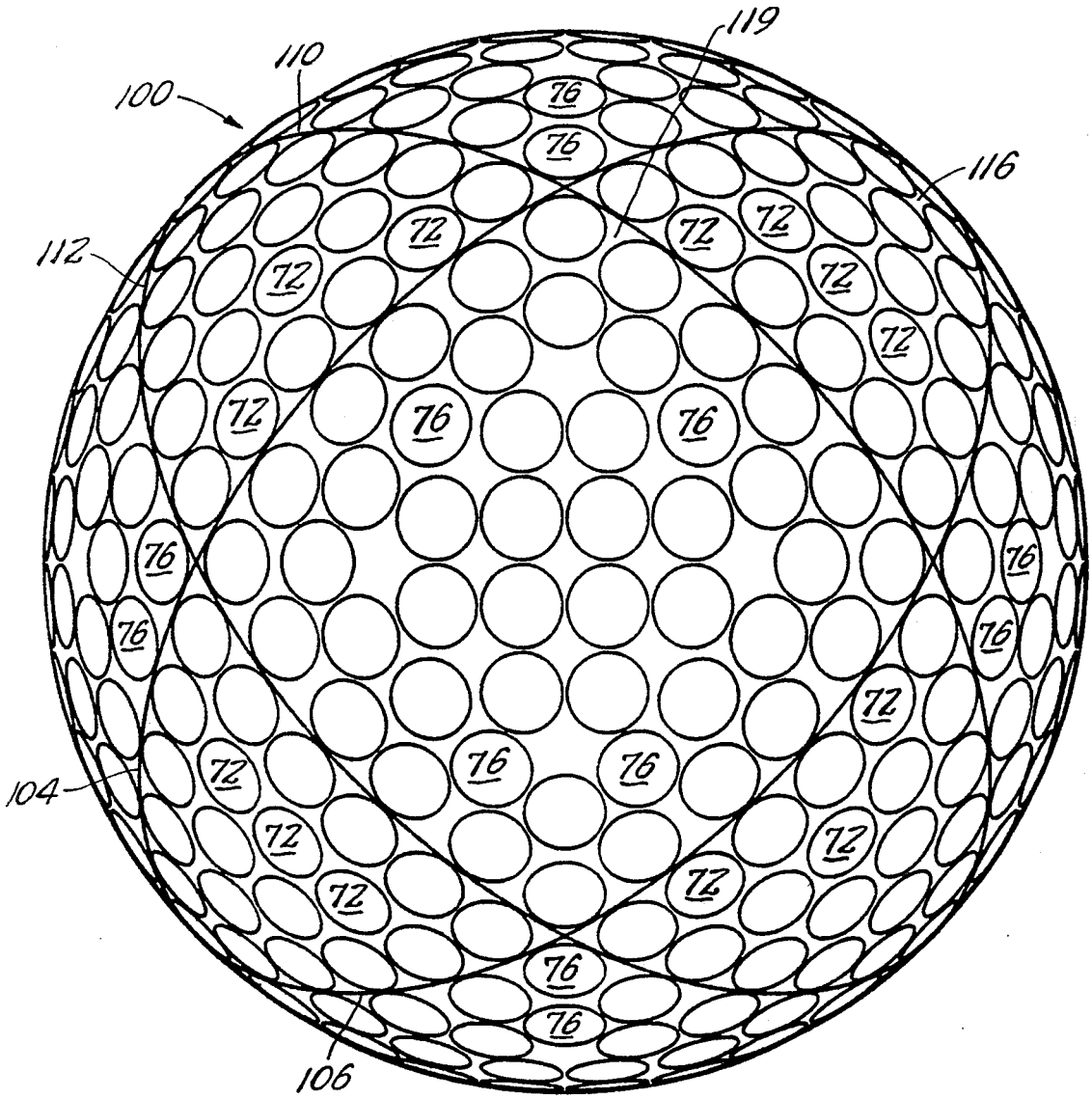
FIG. 9 illustrates a projected golf ball having 456 dimples made in accordance with the present invention.

FIG. 9 is a projected view of a preferred golf ball made in accordance with the present invention, having 456 dimples thereon. On golf ball 100, dimples 72 and 76 are arranged using the pattern of FIGS. 3 and 4, respectively. Great circular paths 104, 106, 110 and 112 are labeled. Dimples 72 and 76 on golf ball 100 have a diameter of about 0.129 and about 0.132 inches, respectively. Equilateral triangle 116 is identified. Square face 119 has been labeled.

Figure 10:
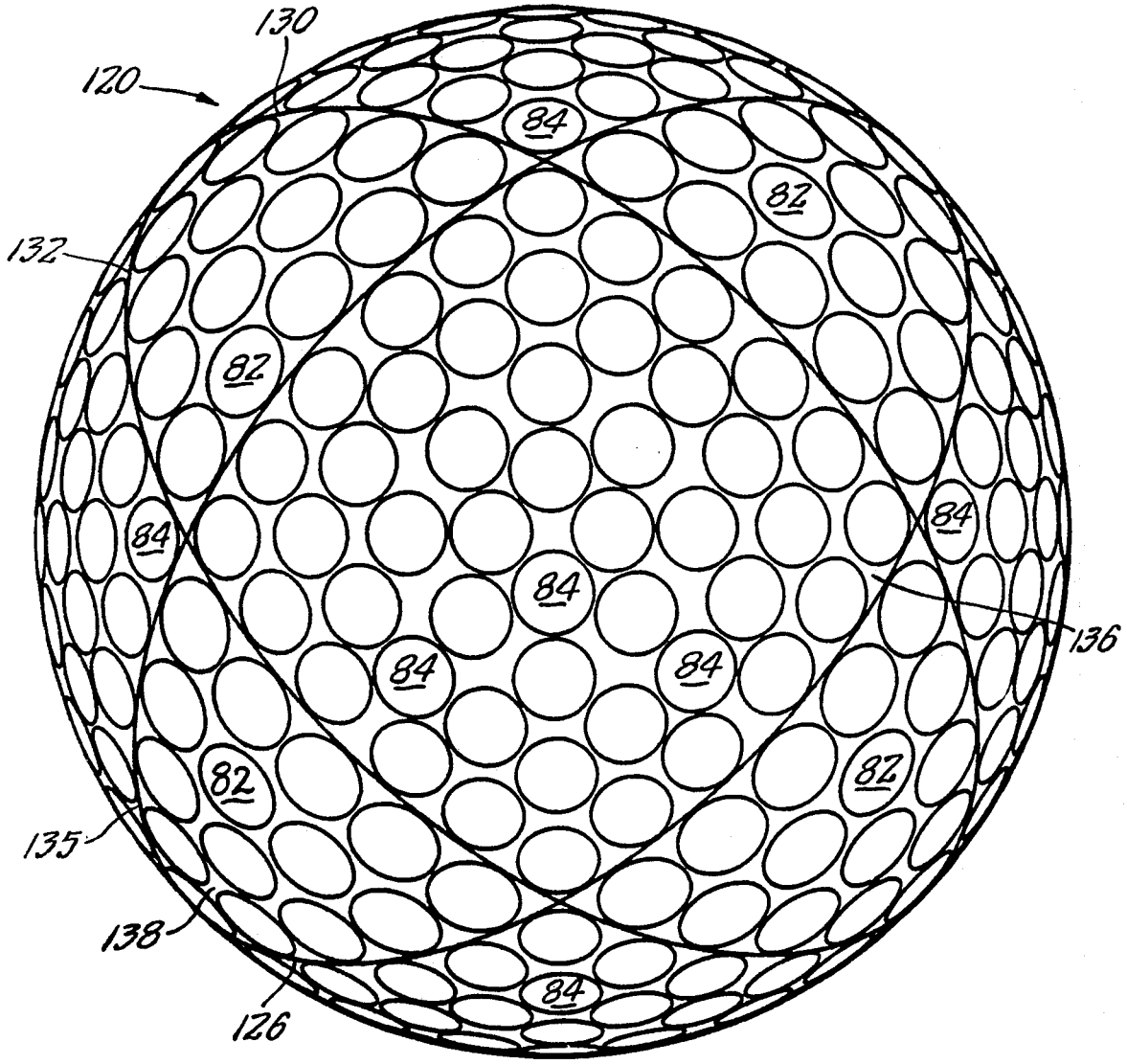
FIG. 10 illustrates a projected golf ball having 408 dimples made in accordance with the present invention.

FIG. 10 is a projected view of a preferred golf ball made in accordance with the present invention and having 408 dimples thereon. On golf ball 120, dimples 82 and 86 are arranged using the patterns of FIGS. 5 and 6, respectively. Dimples 82 and 86 have a diameter of about 0.153 and about 0.134 inches, respectively. Great circular paths 126, 130, 132 and 135 are labeled. Square 136 is identified in FIG. 10 while equilateral triangle 138 is also identified.

Figure 11:
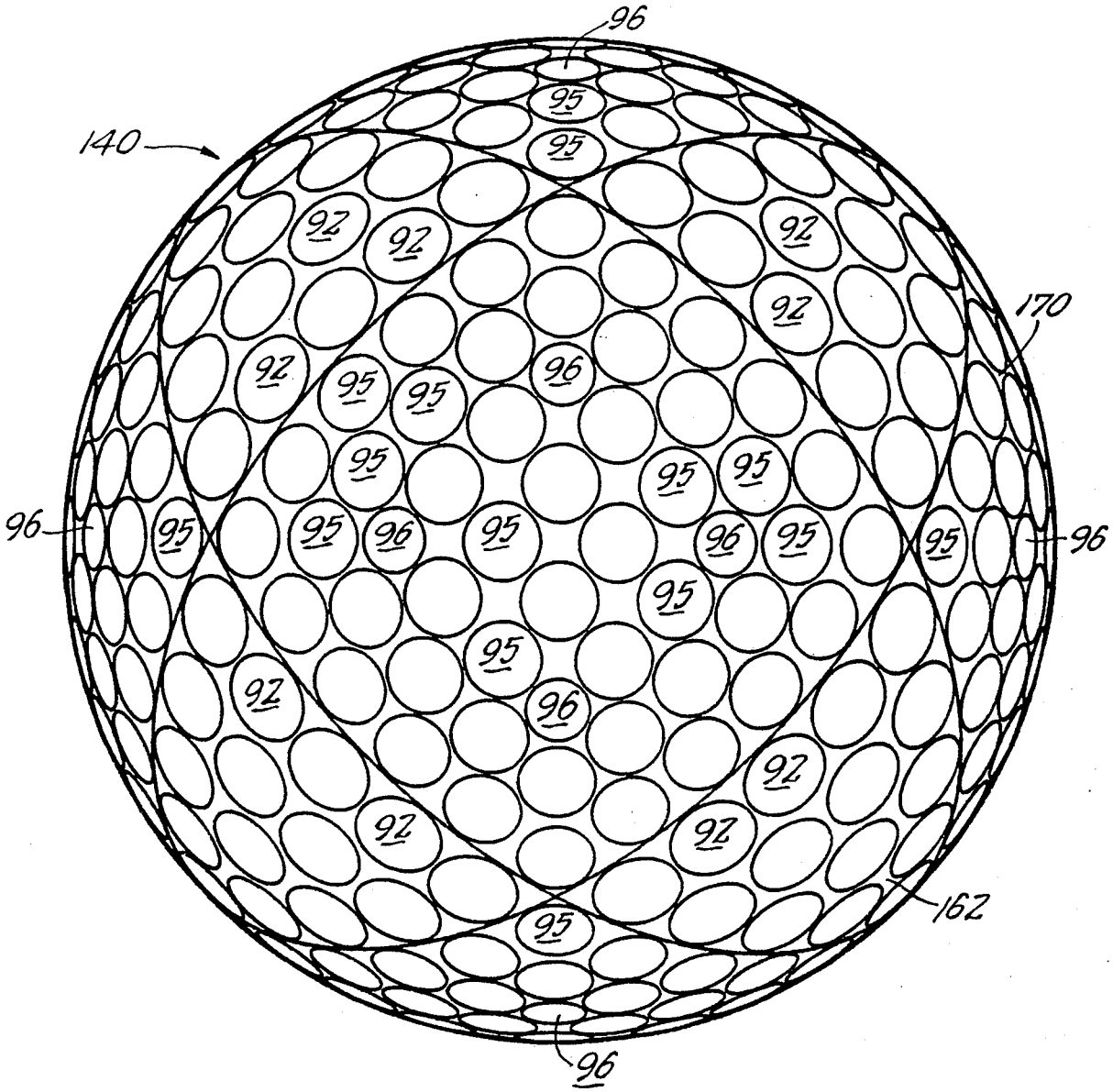
FIG. 11 illustrates a projected golf ball having 432 dimples made in accordance with the present invention.

FIG. 11 is a projected view of a preferred golf ball made in accordance with the present invention and having 432 dimples thereon. On golf ball 140, dimples 92 are arranged thereon using the pattern of FIG. 7, while dimples 95 and 96 are arranged thereon using the pattern of FIG. 8. Dimples 92 have a diameter of about 0.153 inches, dimples 95 have a diameter of about 0.132 inches and dimples 96 have a diameter of about 0.110 inches. Great circular paths 150, 154, 158 and 160 are labeled. Equilateral triangle 162 is shown along with square 170, both of which are used to make golf ball 140.

For any number appearing in the claims which is not modified by the term "about", it will be understood that the term "about" modifies such number. A dimple, as used in the specification and claims and as used in the golf industry, is a standard term well-known to those of skill in the art.

When referring to a dimple diameter, the term "diameter" as used herein means the diameter of a circle defined by the edges of the dimple. When the edges of a dimple are non-circular, the diameter means the diameter of a circle which has the same area as the area defined by the edges of the dimples. When the term "depth" is used herein, it is defined as the distance from the continuation of the periphery line of the surface of the golf ball to the deepest part of a dimple which is a section of a sphere. When the dimple is not a section of a sphere, the depth in accordance with the present invention is computed by taking a cross-section of the dimple at its widest point. The area of the cross-section is computed and then a section of a circle of equal area is substituted for the cross-section. The depth is the distance from the continuation of the periphery line to the deepest part of the section of the circle.

It will be understood that the claims are intended to cover all changes and modifications of the preferred embodiment of the invention herein chosen for the purpose of illustration which do not constitute a departure from the spirit and scope of the invention.

What is claimed is:

1. A golf ball having a spherical surface with a plurality of dimples formed therein, and four parting lines which do not intersect any dimples, the dimples being arranged by dividing the surface of the golf ball into eight equilateral triangles and six squares, said eight triangles and six squares being formed by inscribing an octahedron in said spherical surface, locating the midpoint on each edge of said octahedron and forming four great circular paths on said spherical surface wherein each great circular path has a diameter equal to said spherical surface's diameter and each great circular path passing through six midpoints, said four parting lines corresponding to said four great circular paths, said dimples being arranged in said eight equilateral triangles and six squares such that the dimples do not intersect the four parting lines.

2. The golf ball of claim 1 wherein each one of said six squares has a dimple pattern substantially similar to each other square and each one of said eight equilateral triangles has a dimple pattern substantially similar to each other equilateral triangle.

3. The golf ball of claim 2 wherein the dimples positioned in each of said six squares have a maximum dimple diameter of about 0.139 inches; the dimples positioned in each of said eight equilateral trangles have a maximum dimple diameter of about 0.136 inches; and at least about 65% of the spherical surface of said golf ball is covered with dimples.

4. The golf ball of claim 2 wherein the dimples positioned in each of said six squares have a maximum dimple diameter of about 0.141 inches; the dimples positioned in each of said eight equilateral trangles have a maximum dimple diameter of about 0.161 inches; and at least about 65% of the spherical surface of said golf ball is covered with dimples.

5. The golf ball of claim 2 wherein the dimples positioned in each of said six squares have a maximum dimple diameter of about 0.139 inches; the dimples positioned in each of said eight equilateral trangles have a maximum dimple diameter of about 0.161 inches; and at least about 65% of the spherical surface of said golf ball is covered with dimples.

6. The golf ball of claim 3, 4 or 5 wherein the dimples have at least two different dimple sizes.

7. A golf ball having a spherical surface with a plurality of dimples therein and four great circular paths which do not intersect any dimples and which have a diameter equal to the spherical surface diameter, the circular paths being arranged on the spherical surface by inscribing an octahedron in the spherical surface, locating each midpoint of each edge of said octahedron and connecting each midpoint to form said great circular paths, each great circular path passing through six midpoints and defining eight equilateral triangles and six squares on said spherical surface.

8. The golf ball of claim 7 wherein each one of said six squares has a dimple pattern substantially similar to each other square and each one of said eight equilateral triangles has a dimple pattern substantially similar to each other equilateral triangle.

9. The golf ball of claim 8 having a total of 456 dimples wherein the dimples positioned in said six squares have a maximum dimple diameter of about 0.139 inches; the dimples positioned in said eight equilateral triangles have a maximum dimple diameter of about 0.136 inches; and at least about 65% of the spherical surface of said golf ball is covered with dimples.

10. The golf ball of claim 8 having a total of 408 dimples wherein the dimples positioned in said six squares have a maximum dimple diameter of about 0.141 inches; the dimples positioned in said eight equilateral triangles have a maximum dimple diameter of about 0.161 inches; and at least about 65% of the spherical surface of said golf ball is covered with dimples.

11. The golf ball of claim 8 having a total of 432 dimples wherein the dimples positioned in said six squares have a maximum dimple diameter of about 0.139 inches; the dimples positioned in said eight equilateral triangles have a maximum dimple diameter of about 0.161 inches; and at least about 65% of the spherical surface of said golf ball is covered with dimples.

12. The golf ball of claim 9, 10 or 11 wherein the dimples have at least two different dimple sizes.

13. A golf ball having a spherical surface with a plurality of dimples therein and four parting lines which do not intersect any dimples, said four parting lines corresponding to four great circular paths which are located by locating and connecting a midpoint of each edge of an octahedron which has been inscribed in said spherical surface, each of said four great circular paths having a diameter equal to said spherical surface diameter and each of said four great circular paths intersecting six midpoints.

* * * * *